United States Patent [19]

Dyson

[11] Patent Number: 4,826,515

[45] Date of Patent: May 2, 1989

[54] VACUUM CLEANING APPARATUS

[75] Inventor: James Dyson, Bathford, England

[73] Assignee: Prototypes, Ltd., Bath, England

[21] Appl. No.: 164,067

[22] Filed: Mar. 3, 1988

Related U.S. Application Data

[63] Continuation of Ser. No. 628,346, Jul. 6, 1984, abandoned, which is a continuation-in-part of Ser. No. 452,917, Dec. 27, 1982, abandoned, which is a continuation of Ser. No. 274,252, Jun. 16, 1981, abandoned.

[30] Foreign Application Priority Data

| | | | |
|---|---|---|---|
| Jun. 19, 1980 | [GB] | United Kingdom | 8020041 |
| Aug. 8, 1980 | [GB] | United Kingdom | 8025960 |
| Sep. 25, 1980 | [GB] | United Kingdom | 8030964 |
| Sep. 26, 1980 | [GB] | United Kingdom | 8031121 |

[51] Int. Cl.[4] ..... B01D 45/12; B04C 5/26

[52] U.S. Cl. ..... 55/345; 55/424; 55/429; 55/459.1; 55/DIG. 3

[58] Field of Search ..... 55/345, 424, 429, 436, 55/439, 459.1, DIG. 3; 209/144; 210/512.1, 512.2

[56] References Cited

U.S. PATENT DOCUMENTS

| | | | |
|---|---|---|---|
| 420,072 | 1/1890 | Johnson et al. | 55/345 |
| 450,372 | 4/1891 | Morse | 55/424 |
| 883,413 | 3/1908 | Mahony . | |
| 1,023,082 | 4/1912 | Kluge . | |
| 1,127,896 | 2/1915 | Keller | 55/345 X |
| 1,826,798 | 10/1931 | Lee . | |
| 1,897,144 | 2/1933 | Prouty . | |
| 1,953,944 | 4/1934 | Becker | 15/335 |
| 2,014,287 | 9/1935 | Newman | 55/429 |
| 2,143,421 | 1/1939 | Loehr et al. | 55/424 |
| 2,171,248 | 8/1939 | Van Berkel | 55/472 X |
| 2,176,467 | 10/1939 | Milner, Jr. et al. | 15/335 X |
| 2,347,731 | 5/1944 | Boivie | 55/459.1 X |
| 2,392,872 | 1/1946 | Wolfe | 55/345 |
| 2,397,980 | 4/1946 | Petri | 55/429 X |
| 2,402,845 | 6/1946 | Rodman | 55/345 |
| 2,405,625 | 8/1946 | Whiton et al. . | |
| 2,498,832 | 2/1950 | Watson et al. | 209/144 |
| 2,504,846 | 4/1950 | Kirby | 15/335 X |
| 2,608,268 | 8/1952 | Gerber . | |
| 2,768,707 | 10/1956 | Campbell | 55/429 X |
| 2,824,335 | 2/1958 | Moffat | 15/353 X |
| 2,837,172 | 6/1958 | Klein et al. | 55/345 |
| 2,993,223 | 7/1961 | Krammes | 15/320 |
| 3,235,090 | 2/1966 | Bose et al. | 210/512.1 |
| 3,283,480 | 11/1966 | Szego | 55/340 |
| 3,320,727 | 5/1967 | Farley et al. | 55/472 |
| 3,425,192 | 2/1969 | Davis | 55/345 |
| 3,501,014 | 3/1970 | Fitch, Jr. et al. | 210/512.1 |
| 3,535,854 | 10/1970 | Taylor | 55/459.1 X |
| 3,853,518 | 12/1974 | Tu et al. | 55/337 |
| 3,877,902 | 4/1975 | Eriksson et al. | 55/337 |
| 3,955,236 | 5/1976 | Mekelburg | 55/337 X |
| 4,005,998 | 2/1977 | Gorman | 55/459.1 X |
| 4,162,149 | 7/1979 | Mekelburg | 55/315 |
| 4,198,290 | 4/1980 | Summers | 55/345 X |
| 4,204,849 | 5/1980 | Johnston | 55/345 X |
| 4,268,288 | 5/1981 | Coombs | 55/337 |

FOREIGN PATENT DOCUMENTS

| | | | |
|---|---|---|---|
| 69708 | 8/1949 | Denmark | 55/459.1 |
| 1355017 | 2/1964 | France | 55/345 |
| 3955 | 3/1972 | Japan | 209/144 |
| 762070 | 11/1956 | United Kingdom | 55/459.2 |

*Primary Examiner*—Robert Spitzer
*Attorney, Agent, or Firm*—Ian C. McLeod

[57] ABSTRACT

A cleaning apparatus including cyclones (11, 52, 81, 107) connected to a uniquely configured receiving chamber (12, 53, 99, 112) is described. The chamber has a diameter furthest from the cone opening (32, 75, 98, 118) at least 3 times the diameter of the cone opening such that dirt is not re-entrained from the chamber. Also described is an apparatus with a sealing member (33, 76, 100, 117) between the receiving chamber and cyclone which provides a seal during air flow and which allows separation of the chamber and cyclone for dirt removal. Also described is a ring second sealing member (34, 104) around an open portion of the receiving chamber which allows removal of the chamber from an outer container (10, 80) to facilitate emptying dirt.

23 Claims, 4 Drawing Sheets

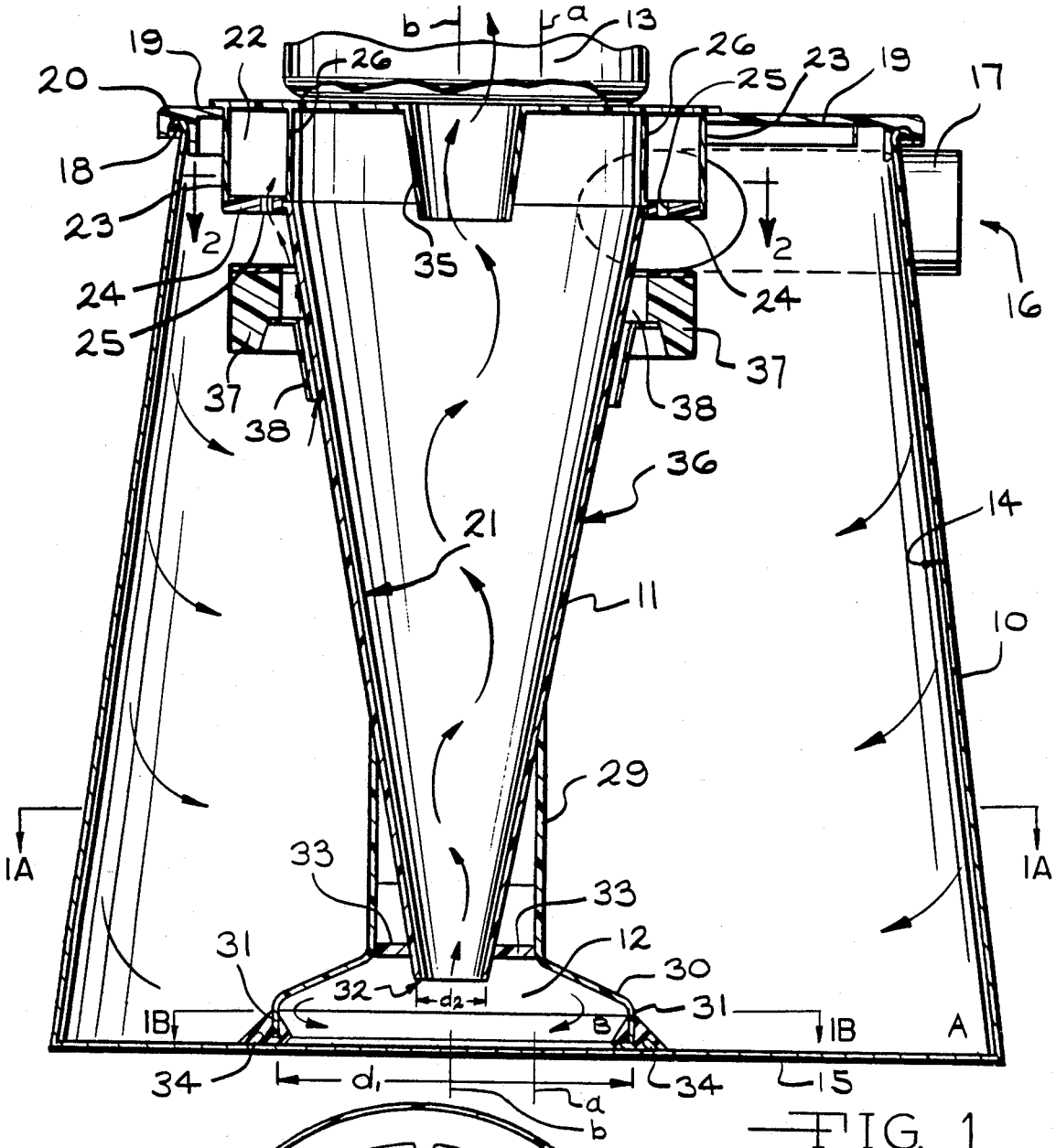
FIG. 1
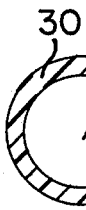
FIG. 1B
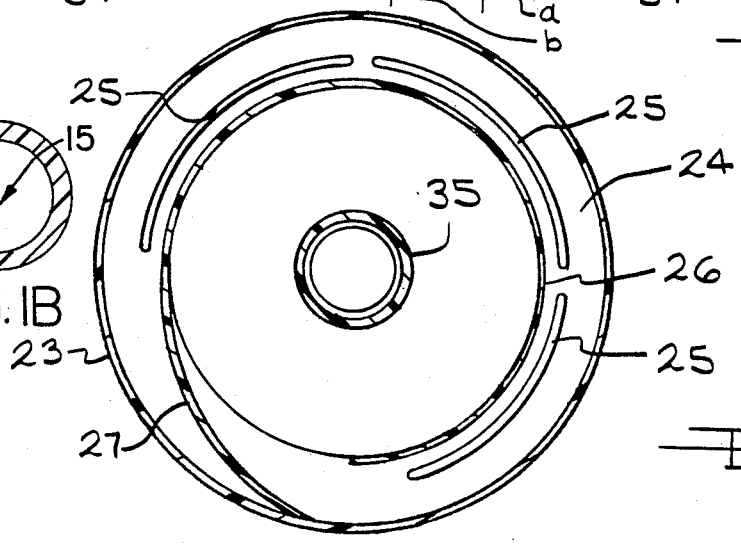
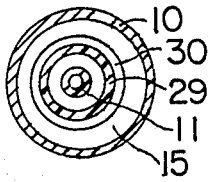
FIG. 1A
FIG. 2

FIG. 3
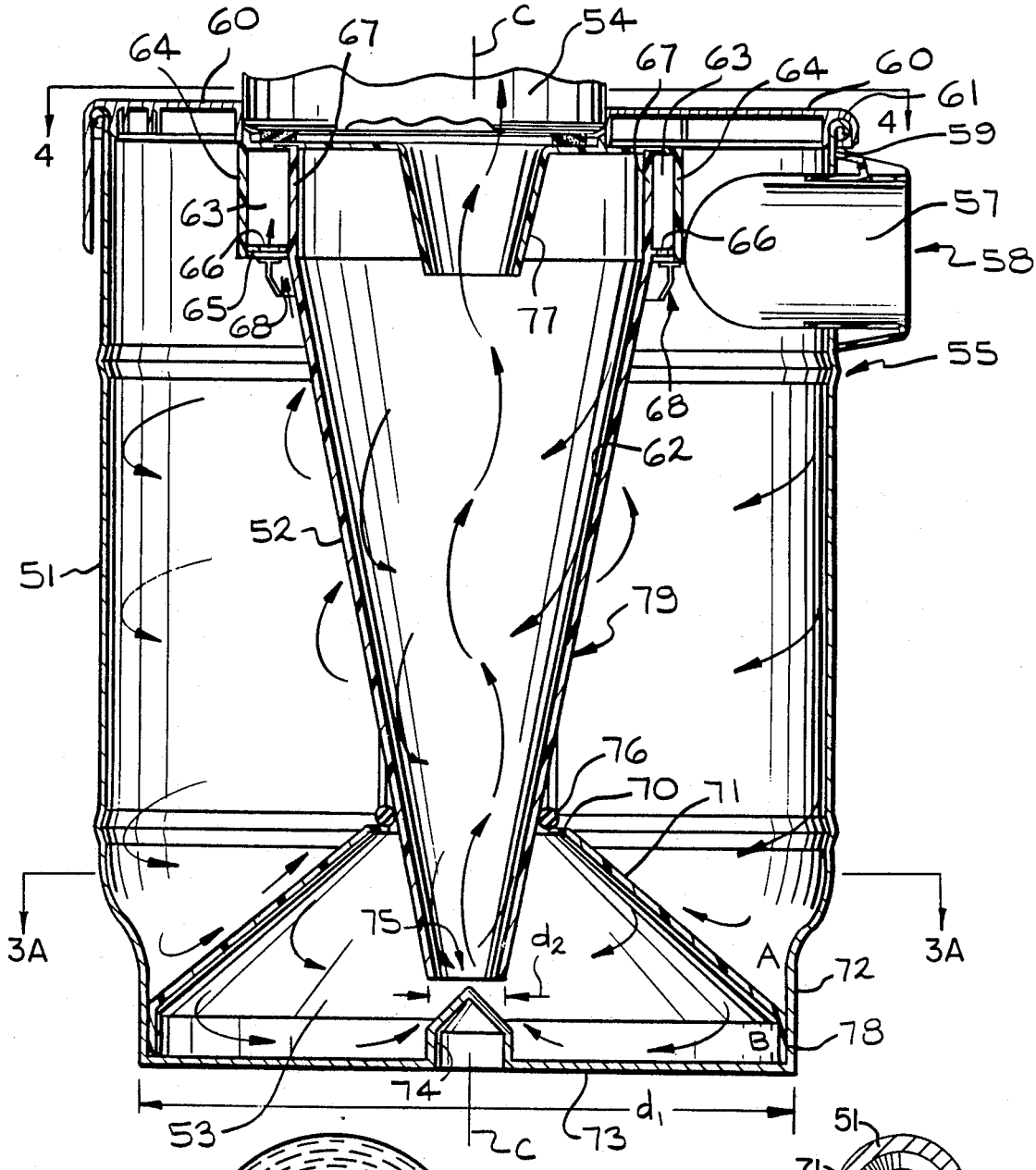
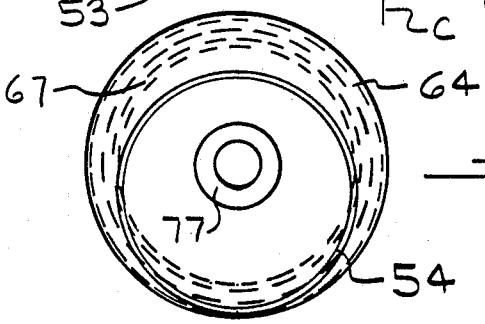
FIG. 4
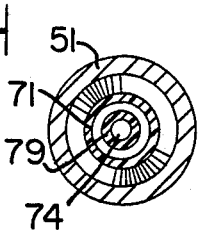
FIG. 3A

VACUUM CLEANING APPARATUS

This is a continuation of co-pending application Ser. No. 628,346 filed on July 6, 1984, now abandoned which is a continuation-in-part of U.S. application Ser. No. 452,917, filed Dec. 27, 1982, now abandoned, which is in turn a continuation of U.S. application Ser. No. 274,252, filed June 16, 1981, now abandoned.

BACKGROUND OF THE INVENTION (1) Field of the Invention

This invention relates to an improved vacuum cleaning apparatus which includes at least one cyclone unit for dust extraction. Preferably the present invention relates to a vacuum cleaning apparatus of the type in which a cleaner duct or pipe for contacting a dirty surface is connected to the interior of a casing in which an air-flow is set up by a motor-driven fan. The casing contains at least one cyclone unit operating to extract dirt particles (dust and other extraneous or foreign matter) from the air-flow therethrough, and to deposit the extracted dirt.

(2) Prior Art

A cleaning apparatus based only on cyclone units has the advantage that dust bags are not required as dirt can be discharged from the apparatus by removing and separating the cyclone from the surrounding casing. Other advantages are that the air discharged from the appliance is substantially dust free and the use of filters as main cleaning elements is avoided. Conventionally the body of a prior art cyclone unit is substantially frusto-conical with the narrow end lower most. This cyclone works very well, however, improvements in efficiency were needed.

EPC Patent Specification No. 0 042 723 and U.S. patent application No. 452,917 describe an outer cyclone or casing of lower efficiency having a cylindrical form. The lower efficiency is in respect of the cyclone's capability of extracting very fine dust particles. A higher efficiency inner cyclone of frusto-conical shape is provided inside the outer cyclone. In these cyclones dirty air is caused to enter the cyclone tangentially at the upper end of the cyclone body, cleaned air is exhausted from the cyclone body through an axially located exhaust port in the upper half of the body and dust and other foreign particles collect at the bottom of the cyclone body. For dual cyclone apparatus the air flow is repeated in the same manner.

In both types of cyclone, i.e. the high efficiency frusto-conical and the low efficiency fine dust cyclone, particles collected at the bottom of the cyclone may become re-entrained in the air-flow in the body, or may never settle out at the bottom of the body, remaining entrained in the air-flow through the cyclone. In either of these circumstances the dust particles are caused to rise up towards the exhaust port, in the axially upwardly moving air-flow within the cyclone body from the dust collected in the cyclones. Thus said dust is exhausted from the cyclone contaminating the otherwise cleaned air.

Objects

It is an object of the present invention to provide means whereby the separated dust is prevented from becoming entrained in the axially upwardly moving air-flow in the cyclone. Further it is an object of the present invention to provide a vacuum cleaning apparatus which is simple and economical to construct and use and which provides ease of emptying of the dust from the apparatus. These and other objects will become increasingly apparent by reference to the following description and to the drawings.

In the Drawings

FIG. 1 is a front cross-sectional view of a preferred canister type vacuum cleaning apparatus including an outer cyclone and an inner cyclone with a receiving and collecting chamber according to the present invention.

FIG. 1A is a plan view showing a cross-section along line 1A—1A of FIG. 1. FIG. 1B is a plan view showing a cross-section of the receiving chamber 30 along line 1B—1B of FIG. 1.

FIG. 2 is a plan cross-sectional view along line 2—2 of FIG. 1 showing the tangential air inlet into the inner cyclone.

FIG. 3 is a front cross-sectional view of another canister type vacuum cleaning appliance showing a modified receiving chamber from that shown in FIG. 1.

FIG. 3A is a plan view showing a cross-section along line 3A—3A of FIG. 3.

FIG. 4 is a plan cross-sectional view along line 4—4 of FIG. 3.

GENERAL DESCRIPTION

Figures 5, 5A:
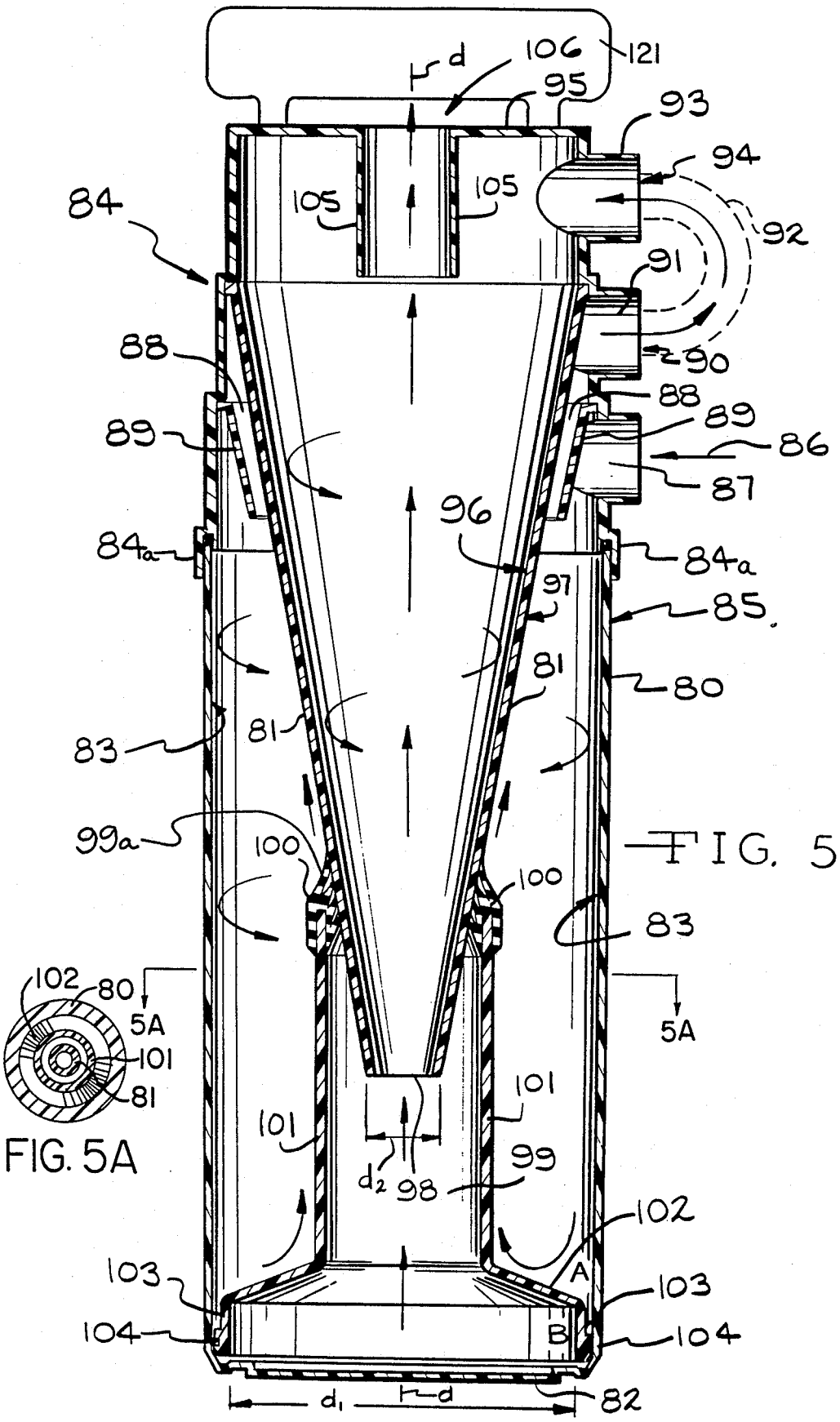
FIG. 5 is a front cross-sectional view of the preferred upright vacuum cleaning apparatus showing the inner and outer cyclones as described in U.S. application Ser. No. 452,917 with an improved receiving chamber on the inner cyclone.
FIG. 5A is a plan view showing a cross-section along line 5A—5A of FIG. 5.

The present invention relates to a cleaning apparatus comprising: a circular cross-sectioned cyclone (11, 52, 81, 107) with a longitudinal axis comprising an air inlet (22, 63, 94, 109) at an upper end thereof, an interior dirt rotational surface (21, 62, 96, 119) of frusto-conical shape for receiving an air flow from the air inlet and maintaining its velocity to a cone opening (32, 75, 98, 118) smaller in diameter than the upper end of the cyclone, an outer surface (36, 79, 97, 120) and a cyclone air outlet (35, 77, 105, 111) communicating with the interior of said cyclone adjacent to the upper end of the cyclone; and a closed dirt receiving and collecting chamber (12, 53, 99, 112) connected to a portion of the outer surface of the cyclone such that a portion of the cyclone and cone opening projects into the receiving chamber, wherein the receiving chamber has a circular cross-sectioned surface around the axis which acts as a cyclone surface for dirt removal with a minimum diameter of the cross-section furthest from the cone opening of 3 times the diameter of the cone opening, wherein an air flow is generated in the apparatus which passes sequentially through the air inlet, the cyclone, the receiving chamber and the cyclone air outlet, the air flow rotating around the interior surface of said cyclone and receiving chamber and depositing the dirt in the receiving chamber.

Preferably the receiving chamber has an inner tapered surface which increases in diameter away from the cone opening. It is an important feature of the present invention for dust collection to avoid entrainment of dust in the clean air that these receiving chambers have a minimum diameter at least three times the diameter of the cone opening.

In particular the present invention relates to a cleaning apparatus comprising: an outer container (10, 51, 80) comprising a bottom (15, 73, 82) and a sidewall extending to and meeting the bottom, a dirty air inlet (16, 58, 86) at an upper portion of the outer container spaced from the bottom for supplying dirt laden air into the container; a circular cross-sectioned cyclone (11, 52, 81) with a longitudinal axis mounted inside the container, the cyclone comprising a cyclone air inlet (22, 63, 94) at an upper end having a first diameter of the cyclone in air communication with the container, an interior dirt rotational surface (21, 62, 96) of frusto-conical shape for receiving an air flow from the air inlet and for maintaining its velocity to a cone opening (32, 75, 98) smaller in diameter than the diameter of the upper end of the cyclone, an outer surface (36, 79, 97) of frusto-conical shape, and a cyclone air outlet (35, 77, 105) communicating with the interior of the cyclone adjacent the upper end of the cyclone; a dirt receiving and collecting chamber (12, 53, 99, 112) extending from the bottom of the container to a portion of the outer surface of the cyclone such that a portion of the inner cyclone projects into the receiving chamber wherein the receiving chamber has a circular cross-sectioned inner tapered surface (30, 71, 102) around the axis having a frusto-conical shape increasing in diameter away from the cone opening and cyclone with a minimum diameter furthest from the opening of three times the diameter of the cone opening; and means (13, 54) for generating an air flow which passes sequentially through the dirty air inlet, the container, the cyclone air inlet, the cyclone, the receiving chamber and the cyclone air outlet, the air flow rotating around the frusto-conical interior surface of the cyclone and receiving chamber depositing the dirt in the receiving chamber. The outer container is preferably a cyclone having surfaces which are substantially cylindrical or tapered away from a longitudinal axis to provide a relatively low efficiency separation for vacuum cleaning appliance applications.

Basically the larger diameter receiving chamber, relative to the opening in the inner cyclone, slows the velocity of the dust particles and allows them to agglomerate by electrostatic attenuation or other means due to rotational movement of the air. In prior art designs the dust particles were moving too fast to be completely agglomerated.

According to one preferred aspect of the present invention there is provided a vacuum suction cleaning appliance including a cyclone unit and means for generating an air-flow from a dirty air inlet through said cyclone unit, characterized in that a receiving chamber is provided at the end of the cyclone remote from the dirty air inlet, within which region the velocity of dust particles is substantially reduced thereby allowing the particles to settle out and collect in the receiving chamber and not be entrained in the clean air.

The receiving chamber is defined by structure which extends radially outwardly from the portion of the cyclone body. The dust enters the receiving chamber, after descending within the cyclone body in a spiral path adjacent to the surface thereof, and is allowed to move radially outwardly from the longitudinal axis of the cyclone under the influence of a centrifugal force in the receiving chamber. The dust thus accumulates at the radial extremity of the receiving chamber spaced a substantial distance from the cone opening and the upwardly moving axial clean air current.

In our above mentioned published EPC Specification No. 0 042, 723 and in U.S. Ser. No. 452,917 a vacuum suction cleaning appliance is described which comprises two cyclone units in series operating successfully to extract dirt particles from the air-flow therethrough. In the appliance one of the two cyclone units has a body of substantially frusto-conical shape, this shape serving to increase the velocity of the dirt particles swirling therein and hence render the cyclone capable of depositing fine dust particles in a small diameter receiving chamber relative to the diameter of the cone opening. It was found that this receiving chamber allows entrainment of dust particles because its diameter is too small.

The inner cyclone is sometimes referred to as a "high efficiency" cyclone because of its ability to remove fine dust particles. The outer of the two cyclone units is deliberately constructed to be of lower efficiency relative to dust particles and is incorporated in the air-passage upstream, relative to the inlet for dirty air, of the high efficiency cyclone unit. The "lower efficiency" cyclone is constructed so as to be incapable of dealing effectively with the finest dust particles, i.e. particles of 50 microns diameter or under, and carries out a primary cleaning action of the dirty air-flow by depositing larger dirt particles but leaving the finer dust particles 50 microns and smaller in the air. The high efficiency cyclone is then left to function in its own optimum conditions with comparatively clean air and only dust particles of very small size.

In the EPC Specification No. 0 042 723 and U.S. Ser. No. 452,917 an appliance was described wherein the lower efficiency was obtained by omitting the frusto-conical formation and constructing the cyclone casing in a generally cylindrical form with the normal tangential or scroll type air inlet adjacent one upper end.

In a convenient and preferred configuration, a vacuum cleaner casing comprises a generally low efficiency outer cyclone with an inlet for dirty air within the outer cyclone, a high efficiency inner cyclone, a passage way being provided to allow air from the outer cyclone to enter an end part of the inner cyclone. Clean air can then be withdrawn centrally from the inner cyclone and exhausted if necessary through a final filter. A receiving chamber is provided at the end of the inner cyclone remote from the passage from the outer cyclone in spaced relation to the cone opening.

Specific Description

The canister cleaning appliance illustrated in FIGS. 1 and 2 comprises an outer cyclone unit 10, an inner cyclone unit 11, a dust receiving and collection chamber 12 and a motor driven fan unit 13. The apparatus will be described as oriented in FIG. 1. The outer cyclone 10 has a substantially frusto-conical casing comprising a side wall 14 extending to the radial periphery of a circular base 15. The outer cyclone tapers inwardly from the base 15 towards the longitudinal axis a-a of the outer cyclone 10. A dirty air inlet passage 16 communicates through the upper part of the side surface 14 so as to make a tangential entry and to set up a swirling cyclonic flow of air. The end part 17 of the dirty air inlet passage 16, remote from the outer cyclone 10, is joined via a flexible tube (not shown) to a cleaner head (not shown) for contacting a dirty surface.

A semi-circular cross-sectioned flange 18 extends radially outwardly from the upper end part of the side wall 14. A cover 19, circular in plan view, having a peripheral recess 20 dimensioned to engage the flange 18, is engaged by said recess on the flange 18 so as to close off the top of the low efficiency cyclone.

The inner cyclone 11 comprises a frusto-conical body portion 21 and a dependent inlet scroll 22. The inlet scroll 22 comprises a tubular sleeve 23 (see FIGS. 1 and 2), which depends from the cover 19 to a horizontal annular web 24. The web 24 extends between the upper end part of the frusto-conical body portion 21 and the lower end part of the sleeve 23, and is perforated by a plurality of slots as the air outlet from the cyclone 10. The scroll 22 is completed by a second dependent sleeve 26, which extends between the cover 19 and the upper end part of the frusto-conical body portion 21 and the web 24. The second sleeve 26 is located radially inwardly of the tubular sleeve 23 and through the majority of its length, see FIG. 1, extends from the top of the frusto-conical body 21 where the latter joins the inner periphery of the web 24. A portion 27 of the second sleeve 26 extends, in the form of a spiral, from the junction of the frusto-conical body 21 and the web 24 to the tubular sleeve 23 thereby completing the scroll 22 and providing a tangential entry to the inner cyclone in order to be capable of setting up a swirling cyclonic flow of air.

The dirt collection box 12 comprises a first cylindrical portion 29, a frusto-conical portion 30 which extends radially outwardly and downwardly from the lower end of the first cylindrical portion 29, to a second larger diameter cylindrical portion 31. The lower end part of the inner cyclone 11 is engaged in the first cylindrical portion 29 so that the opening 32 at the bottom of the cyclone body 21 lies radially inwardly of the frusto-conical portion 30 of the receiving chamber 12. A flexible annular sealing member 33 is provided between the first cylindrical portion 29 and the inner cyclone 11, immediately above the opening 32. Interposed between the larger diameter cylindrical portion 31 and the base 15 is a second flexible annular sealing member 34. The motor driven fan unit 13 is located on the cover 19, above the inner cyclone 11 and is arranged so as to draw air from said cyclone 11 through a dependent tube 35. The dependent tube 35 extends downwardly from the cover 19 substantially coaxially with the high efficiency cyclone 11. The outer surface 36 of the inner cyclone 11 is preferably frusto-conical in shape although this is not necessary. As shown in FIG. 1, an air flow directing ring 37 is provided around the outer surface 36 of the inner cyclone 11 which directs the air flow through passage 38 to slots 25 as shown by the arrows. Dirt collects in the inner cyclone as shown at B and in the outer cyclone 10 as shown by A.

The cleaning appliance illustrated in FIGS. 3 and 4 is similar to that shown in FIGS. 1 and 2 and will be described as oriented in FIG. 3. The appliance comprises an outer cyclone unit 51, an inner cyclone 52, a receiving chamber 53 and a motor driven fan unit 54. The outer cyclone 51 has a substantially cylindrical casing comprising a side surface 55 upstanding from the radial periphery of the receiving chamber 53, the upper surface of which serves as the base to the outer cyclone unit 51.

A dirty air inlet passage 57 communicates through the upper part of the side surface 55 so as to make a tangential entry and to set up a swirling cyclonic flow of air. The end part 58 of the dirty air inlet passage 57 remote from the outer cyclone, is joined via a flexible tube (not shown) to a cleaner head (not shown) for contacting a dirty surface.

A semi-circular cross-sectioned flange 59 extends radially outwardly from the upper end part of the side wall 55. A cover 60, circular in plan, having a peripheral recess 61 dimensioned to engage the flange 59, is engaged by said recess 61 in the flange 59 so as to close off the top of the outer cyclone 51.

The inner cyclone 52 comprises a frusto-conical inner surface 62 and a dependent scroll 63. The inlet tangential air inlet flow passage or inlet scroll 63 comprises a tubular sleeve 64 (see FIGS. 3 and 4), which depends from the cover 60 to a horizontal annular web 65. The web 65 extends between the upper end part of the frusto-conical body portion 62 and the lower end part of the sleeve 64, and is perforated by a plurality of slots 66 as the air outlet from the cyclone 51. The scroll 63 is completed by a second dependent sleeve 67, which extends between the cover 60 and the upper end part of the frusto-conical body portion 62 and the web 65. The sleeve 67 is located radially inwardly of the tubular sleeve 64 and through the majority of its length, see FIG. 3, extends from the top of the frusto-conical body 62 where the latter joins the inner periphery of the web 65. A portion 68 of the sleeve 67 extends, in the form of a spiral, from the junction of the frusto-conical body 62 and the web 65 to the tubular sleeve 64 thereby completing the tangential air flow passage or scroll 63 and providing a tangential entry to the inner cyclone in order to be capable of setting up a cyclonic flow of air.

The receiving chamber 53 comprises an annular flange 70, a frusto-conical portion 71 which extends radially outwardly and downwardly from the radially outer periphery of the flange 70 to a cylindrical portion 72. The cylindrical portion 72 extends from the radial periphery of a circular base 73 which has substantially the same diameter as the casing of the outer cyclone 51. The upper end part of the cylindrical portion 78 of the receiving chamber 53 is in disengageable sealing engagement with the lower end part of the low efficiency cyclone surface 55. An air deflector 74, in the form of a cylinder topped with a cone, extends from the base 73 coaxially (c—c) with the inner cyclone 52. The lower end part of the inner cyclone 52 is engaged in the annular flange 70 so that the opening 75 at the bottom of the cyclone 52 is located immediately above the top of the deflector 74, within the receiving chamber 53. An annular sealing member 76 is provided between the annular flange 70 and the inner cyclone 52.

The motor driven fan unit 54 is located on the cover 60 above the inner unit 52 and is arranged so as to draw air from the inner cyclone unit 52 through a dependent tube 77. The dependent tube 77 extends downwardly from the cover 60 substantially coaxially with the inner cyclone 52. The cyclone unit 52 has an outer surface 79 which is frusto-conical or any desired shape.

FIG. 5 shows the outer cyclone 80 and the inner cyclone 81 adapted for an upright vacuum cleaning appliance as shown in U.S. Ser. No. 452,917. Thus the cyclones are relatively long and slender as compared to those shown in FIGS. 1 and 3; however the air flow is the same. The outer cyclone 80 has a bottom 82 and cylindrical inner surface 83. The outer cyclone 80 is removable from an air flow directing head 84, which has lips 84a which engage the outside surface 85 of the outer cyclone 80. The heat 84 includes a dirty air inlet passage 86, inlet port 87 and an air directing passage 88 defined by a tapered portion 89 connected to head 84 leading to outlet passage 90 in outlet port 91. As shown by the dotted lines a flexible tube 92 connects the outlet port 91 to an inlet port 93 to a tangential entry passage 94 defined by cylindrical portion 95 of head 84. The inner cyclone 81 has a frusto-conical shape and inner and outer surfaces 96 and 97 leading to a cone opening 98. The outer surface 97 of the inner cyclone 81 engages a receiving chamber 99 with a tapered ring seal 100 with a series of concentric rings on the outer surface 97. The tapered seal 100 including concentric rings 99a is mounted on an elongate cylindrical portion 101 of the receiving chamber 99. The receiving chamber 99 is integral with a frusto-conical or outwardly tapered portion 102 relative to the axis (d—d) which is in turn integral with a short cylindrical portion 103. An o-ring seal 104 provides an air seal between the receiving chamber 99 and the outer cyclone 80. In the cylindrical portion 95 of head 84 an outlet port 105 is provided for removal of clean air through passage 106. The outlet port 105 is connected to a fan unit 121.

Figure 6:
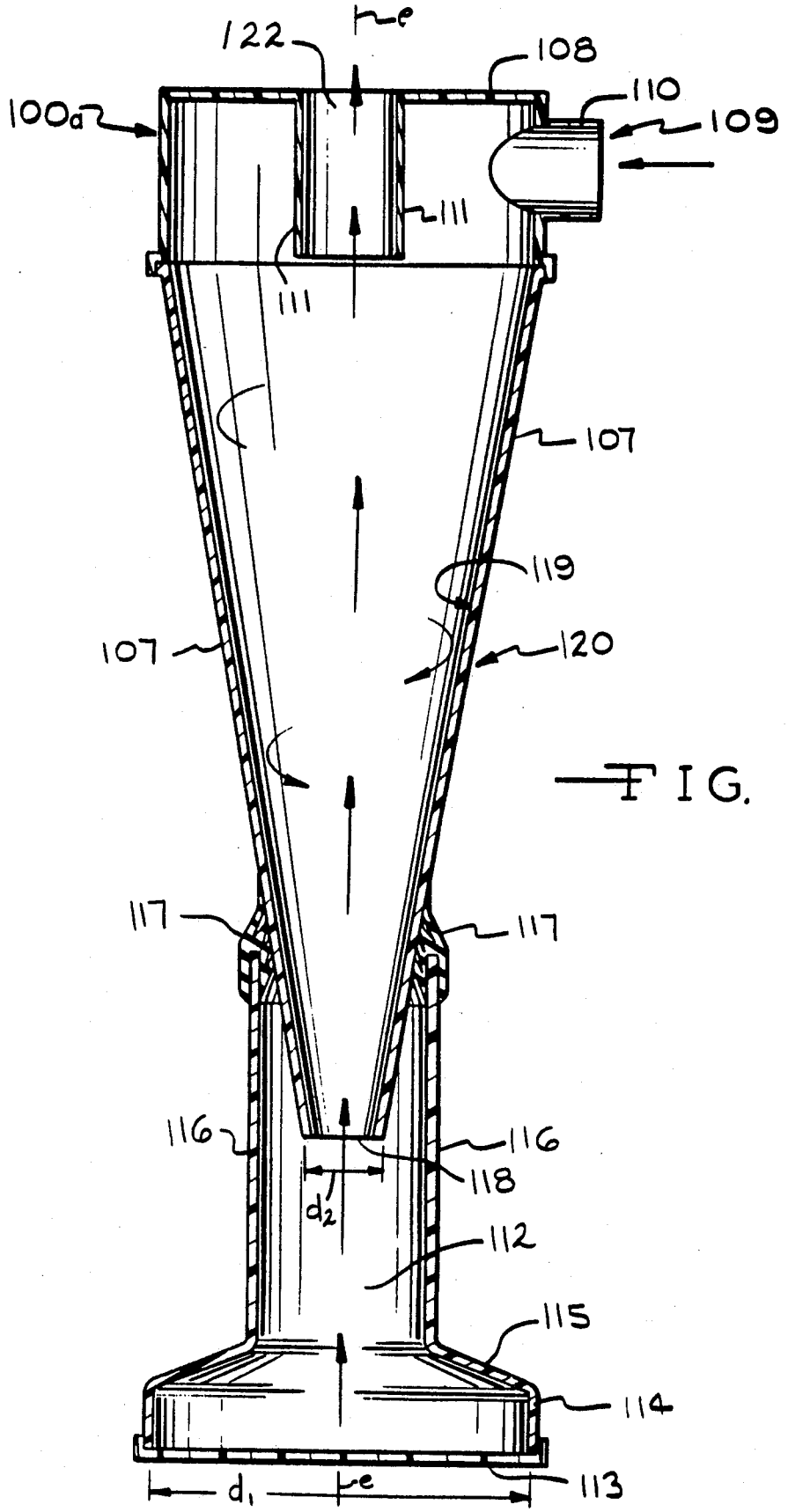
FIG. 6 is a front cross-sectional view of the preferred single cyclone showing air receiving chamber which is preferred for industrial air cleaning applications for dust removal.

FIG. 6 shows a single cyclone 107 symmetrical around axis (e—e) similar to the inner cyclone 81 of Figure 5. The outer cyclone 80 is eliminated and the head 100a is modified for a single cyclone operation. This cyclone 107 operates as a fine dust collector in the same manner as the inner cyclone 81 of FIG. 5 with an inlet passage 109 through inlet port 110 and an outlet passage 122 through outlet port 111. The head 100a is closed by a cover 108. The receiving chamber 112 includes a removable cover 113 over short cylindrical portion 114. Tapered portion 115 is connected to elongate cylindrical portion 116. The cyclone 107 is sealed to the receiving chamber 112 by tapered seal 117. The opening 118 projects into the receiving chamber 112. Frusto-conical inner surface 119 acts to separate the dust particles as before. An outer surface 120 has a similar shape for mounting on the receiving chamber 112. The apparatus of FIG. 6 is particularly suited to fine dust collection.

Both the appliances described above and illustrated in FIGS. 1 to 6 function in substantially the same manner, and the function of the appliances will now be described with operation to the appliance illustrated in FIGS. 1 and 2 only. Reference will be made to the air flow designated by arrows and the successive progress of dirty air through the interior of the cyclones 10 and 11. Similar arrows are shown on FIG. 3 and 4 although the progress of the air will not be described. One significant air flow difference is that the longitudinal axis of the inner and outer cyclones 52 and 51 are concentric on axis (c—c) in FIG. 3, whereas the axis are off-set (a—a and b—b) as shown in FIG. 1; however, the air flow is functionally similar. In FIG. 6 there is only a single cyclone 107.

Dirty air carrying dust and other particles is drawn into the dirty air inlet passage 16. The air stream carrying the dirt particles makes a tangential entry into the upper part of the outer cyclone 10 and performs a cyclonic swirling movement generally along the line of the arrows and thereby deposits the majority of the larger dirt particles in the lower part of the outer cyclone 10 as indicated at A. The centrifugal force on the dirt particles causes them to deposit on surface 14 and fall to the bottom 15 of the outer cyclone 10. The air stream carrying essentially the finer dust particles (50 microns or less) then rises under the influence of the general air flow developed by the fan through the slots 25 in the web 24 and into the scroll 22. The air then makes a tangential entry to the inner cyclone 11 where the cyclonic cleaning process is repeated only with higher efficiency and greater dust particle velocity thereby depositing the finer dust particles. Once the air and dirt entrained therein enters the receiving chamber 12 from the inner cyclone 11 via the opening 32, the dust is thrown outwardly from the axis (b—b) of the inner cyclone and collects at B. Additionally the velocity of the swirling air is reduced by the reverse taper of the frusto-conical portion 30 of the receiving chamber 12 allowing the dust particles to agglomerate at B and prevent them from becoming re-entrained within the air flow. The clean air rises under the influence of the air flow to the upper part of the inner cyclone 11 and exits through the dependent tube 35 to the motor fan 13 and is exhausted.

For discharge of dirt particles the cover 19, carrying the inner cyclone 11 and the receiving chamber 12 is removed and the collected dirt is then emptied from the outer cyclone 10. It will be appreciated that when the receiving chamber 12 is lifted from its seating in the base 15 of the outer cyclone 10 the contents thereof will be deposited so that the outer cyclone 10 holds all the deposited particles. In the apparatus shown in FIGS. 3 and 5, the tapered portion 71 and 102 facilitates removal of the dirt A from the apparatus.

In the apparatus shown in FIG. 1, the cylindrical portion 31 diameter ($d_1$) is at least 3 times the diameter ($d_2$) of the opening 32. In FIG. 3 the diameter ($d_1$) of the cylindrical portion 78 is at least 3 times the diameter ($d_2$) of the opening 75. This construction allows the particles A and B to efficiently agglomerate. In FIGS. 5 and 6 the diameter ($d_1$) of the cylindrical portions 103 and 114 are at least 3 times the diameters ($d_2$) of the openings 98 and 118 from cyclones 81 and 107, respectively. This construction provides for removal of fine dust particles. The basic air flow of the apparatus of FIGS. 5 and 6 is the same as that of FIGS. 1 and 3 as shown by the arrows.

It is preferred that the inner and outer cyclones be constructed of plastic. The cyclonic air flow may charge the dirt particles facilitating their agglomeration at A and B.

Numerous variations in cyclonic construction will occur to those skilled in the art. It is intended that they be included within the scope of the present invention.

I claim:

1. A cleaning apparatus comprising:

(a) an outer container comprising a bottom and a sidewall extending to and meeting the bottom, the sidewall having an interior surface, a dirty air inlet at an upper portion of the outer container spaced from the bottom and is oriented for supplying dirt laden air into the container tangentially to the interior surface of the outer container which has a circular cross-section and an air outlet from the container at the upper portion of the container;

(b) a circular cross-sectioned cyclone with a longitudinal axis mounted inside the container, the cyclone comprising a cyclone air inlet at an upper end having a first diameter of the cyclone in air communication with the air outlet of the container, an interior dirt rotational surface of frusto-conical shape for receiving an air flow from the air inlet and for maintaining its velocity to a cone opening smaller in diameter than the diameter of the upper end of the cyclone, the air inlet being oriented for supplying air tangentially to the surface, an outer surface of frusto-conical shape, and a cyclone air outlet communicating with the interior of the cyclone adjacent the upper end of the cyclone;

(c) a dirt receiving and collecting chamber extending from the bottom of the container to a portion of the outer surface of the cyclone such that a portion of the cyclone projects into the receiving chamber wherein the receiving chamber has a circular cross-sectioned inner tapered surface around the axis having frusto-conical shape increasing in diameter away from the cone opening and cyclone with a minimum diameter furthest from the cone opening of 3 times the diameter of the cone opening; and (d) means for generating an air flow which passes sequentially through the dirty air inlet, the container, the cyclone air inlet, the cyclone, the receiving chamber and the cyclone air outlet, the air flow rotating around the frusto-conical interior surface of the cyclone and the inner tapered surface of the receiving chamber and depositing the dirt in the receiving chamber.

2. A cleaning apparatus comprising:

(a) an outer cyclone comprising a bottom and a sidewall extending to and meeting the bottom, the sidewall having an interior surface having a circular cross-section which acts as a dirt rotation surface, a dirty air inlet at an upper portion of the outer cyclone spaced from the bottom and is oriented for supplying dirt laden air tangentially to the interior surface, and a cyclone air outlet communicating with the interior of the outer cyclone;

(b) a circular cross-sectioned inner cyclone with a longitudinal axis mounted inside the outer cyclone, the inner cyclone comprising an air inlet at an upper end of the cyclone having a first diameter in air communication through a passage with the air outlet of the outer cyclone, an interior dirt rotational surface of frusto-conical shape defining the cyclone for receiving an air flow from the passage and maintaining its velocity to a cone opening smaller in diameter than the diameter of the upper end of the cyclone, the air inlet being oriented for supplying air tangentially to the surface, an outer surface of frusto-conical shape, and an inner cyclone air outlet communicating with the interior of the inner cyclone adjacent the upper end of the cyclone as defined by the frusto-conical shaped surface;

(c) a dirt receiving and collecting chamber extending from the bottom of the outer cyclone and cone opening to a portion of the outer surface of the inner cyclone such that a portion of the inner cyclone and cyclone opening projects into the receiving chamber, wherein the receiving chamber has a circular cross-sectioned inner tapered surface around the axis having a frusto-conical shape increasing in diameter away from the cone opening of the cyclone and with a minimum diameter of the cross-section furthest from the cone opening of 3 times the diameter of the cone opening; and (d) means for generating an air flow which passes sequentially through the dirty air inlet, the outer cyclone, the outer cyclone air outlet, the passage, the inner cyclone, the receiving chamber and the inner cyclone air outlet, the air flow rotating around the interior surface of the outer cyclone, the frusto-conical interior surface of the inner cyclone and the inner tapered surface of the receiving chamber and then is removed through the air outlet.

3. The apparatus of claim 2 wherein the receiving chamber comprises a circular cross-sectioned tubular portion which is cylindrical around the axis with one end connected to the portion of the outer surface of the inner cyclone and the opposite end connected to the tapered surface in spaced relation to the cone opening, wherein the tubular portion has a diameter smaller than the minimum diameter of the tapered surface.

4. The apparatus of claim 2, wherein the receiving chamber and the portion of the outer surface of the inner cyclone are joined together in use and separable for emptying the receiving chamber, wherein the receiving chamber is open adjacent to the bottom of the outer cyclone and wherein a flexible seal is provided between the bottom and the chamber to prevent air leakage between them during use.

5. The apparatus of claim 2 wherein a flexible tapered air seal is provided between the receiving chamber and the outer surface of the inner cyclone such that the inner cyclone is separable from the receiving chamber.

6. The apparatus of claim 2 wherein the interior surface of the outer cyclone is substantially cylindrical.

7. The apparatus of claim 2 wherein the outer cyclone and the inner cyclone are concentric around a common longitudinal axis, wherein the interior surface of the outer cyclone is substantially cylindrical, wherein the receiving chamber comprises a circular cross-sectioned tubular portion which is cylindrical around the axis with one end connected to the portion of the outer surface of the inner cyclone and the opposite end connected to the inner tapered surface of the receiving chamber in spaced relation to the cone opening and wherein the tubular portion has a diameter smaller than the minimum diameter of the tapered wall such that finely divided dirt is trapped in the receiving chamber.

8. The apparatus of claim 7 wherein a flexible tapered seal is provided between the receiving chamber and the outer surface of the inner cyclone such that the inner cyclone is separable from the receiving chamber.

9. The apparatus of claim 8 wherein the tapered seal is composed of a series of concentric rings which engage the outer surface of the inner cyclone to provide the seal.

10. A cleaning apparatus comprising:

(a) an outer container comprising a bottom and a sidewall extending to and meeting the bottom, the sidewall having an interior surface, a dirty air inlet at an upper portion of the outer container spaced from the bottom and is oriented for supplying dirt laden air into the container tangentially to the interior surface of the outer container which has a circular cross-section and an air outlet from the container at the upper portion of the container;

(b) a circular cross-sectioned cyclone with a longitudinal axis mounted inside the container, the cyclone comprising a cyclone air inlet at an upper end having a first diameter of the cyclone in air communication with the air outlet of the container, an interior dirt rotational surface of frusto-conical shape defining the cyclone for receiving an air flow from the air inlet and for maintaining its velocity to a cone opening smaller in diameter than the diameter of the upper end of the cyclone, the air inlet being oriented for supplying air tangentially to the surface, an outer surface of frusto-conical shape, and a cyclone air outlet communicating with the interior of the cyclone adjacent the upper end of the cyclone;

(c) a dirt receiving and collecting chamber extending from the bottom of the container to a portion of the outer surface of the cyclone wherein the receiving chamber has a circular cross-sectioned inner surface around the axis with a minimum diameter furthest from the opening of 3 times the diameter of the cone opening and wherein the chamber is separable from the cyclone to facilitate emptying of the dirt;

(d) seal means between the chamber and cyclone; and (e) means for generating an air flow which passes sequentially through the dirty air inlet, the container, the cyclone air inlet, the cyclone, the receiving chamber and the cyclone air outlet, the air flow rotating around the frusto-conical interior surface of the cyclone and the inner surface of the receiving chamber and depositing dirt in the receiving chamber and then is removed through the air inlet.

11. The cleaning apparatus of claim 10 wherein the chamber is removable from the outer container and second seal means is provided between the container and receiving chamber.

12. The cleaning apparatus of claim 10 wherein the receiving chamber is open adjacent the bottom of the outer container such that dirt remains in the outer container upon removal of the receiving chamber from the outer container.

13. The cleaning apparatus of claim 10 wherein a portion of the cyclone projects into the receiving chamber and wherein the receiving chamber has a circular cross-sectioned inner tapered surface around the axis having a frusto-conical shape increasing in diameter away from the cone opening and cyclone.

14. A cleaning apparatus comprising:

(a) an outer container comprising a bottom and a sidewall extending to and meeting the bottom, the sidewall having an interior surface, a dirty air inlet at an upper portion of the outer container spaced from the bottom and is oriented for supplying dirt laden air into the container tangentially to the interior surface of the outer container which has a circular cross-section and an air outlet from the container at an upper portion of the container;

(b) a circular cross-sectioned cyclone with a longitudinal axis mounted inside the container, the cyclone comprising a cyclone air inlet at an upper end having a first diameter of the cyclone in air communication with the air outlet of the container, an interior dirt rotational surface of frusto-conical shape defining the cyclone for receiving an air flow from the air inlet and for maintaining its velocity to a cone opening smaller in diameter than the diameter of the upper end of the cyclone, the air inlet being oriented for suppyling air tangentially to the surface, an outer surface of frusto-conical shape, and a cyclone air outlet communicating with the interior of the cyclone adjacent the upper end of the cyclone;

(c) a dirt receiving and collecting chamber extending from the bottom of the container to a portion of the outer surface of the cyclone, wherein the chamber and cyclone are separable from the outer container wherein the receiving chamber has a circular cross-sectioned inner surface around the axis with a minimum diameter furthest from the opening of 3 times the diameter of the cone opening and wherein the chamber is open to the bottom of the container to facilitate emptying of the dirt;

(d) ring seal means between the chamber and outer container; and (e) means for generating an air flow which passes sequentially through the dirty air inlet, the container, the cyclone air inlet, the cyclone, the receiving chamber and the cyclone air outlet, the air flow rotating around the frusto-conical interior surface of the cyclone and the inner surface of the receiving chamber and depositing dirt in the receiving chamber.

15. The cleaning apparatus of claim 14 wherein a portion of the cyclone projects into the receiving chamber, wherein the receiving chamber has a circular cross-sectioned inner surface around the axis having a frusto-conical shape increasing in diameter away from the cone opening and cyclone.

16. A cleaning apparatus comprising:

(a) an outer cyclone comprising a bottom and a sidewall extending to and meeting the bottom, the sidewall having an interior surface having a circular cross section which acts as a dirt rotation surface, a dirty air inlet at an upper portion of the outer cyclone spaced from the bottom and is oriented for supplying dirt laden air tangentially to the interior surface, and a cyclone air outlet communicating with the interior of the outer cyclone;

(b) a circular cross-sectioned inner cyclone with a longitudinal axis mounted inside the outer cyclone, the inner cyclone comprising an air inlet at an upper end of the cyclone having a first diameter in air communication through a passage with the air outlet of the outer cyclone, an interior dirt rotational surface of frusto-conical shape defining the cyclone for receiving an air flow from the passage and maintaining its velocity to a cone opening smaller in diameter than the diameter of the upper end of the cyclone, the air inlet being oriented for supplying air tangentially to the surface, an outer surface of frusto-conical shape, and an inner cyclone air outlet communicating with the interior of the inner cyclone adjacent the upper end of the cyclone as defined by the frusto-conical shaped surface;

(c) a dirt receiving and collecting chamber extending from the bottom of the outer cyclone and cone opening to a portion of the outer surface of the inner cyclone such that a portion of the inner cyclone and cyclone opening projects into the receiving chamber, wherein the receiving chamber has a circular cross-sectioned inner tapered surface around the axis having a frusto-conical shape increasing in diameter away from the cone opening of the cyclone and with a minimum diameter of the cross-section furthest from the cone opening of 3 times the diameter of the cone opening; and (d) means for generating an air flow which passes sequentially through the dirty air inlet, the outer cyclone, the outer cyclone air outlet, the passage, the inner cyclone, the receiving chamber and the inner cyclone air outlet, the air flow rotating around the interior surface of the outer cyclone, the frusto-conical interior surface of the inner cyclone and the inner tapered surface of the receiving chamber and then is removed through the air outlet wherein the outer cyclone and the inner cyclone are concentric around a common longitudinal axis, wherein the interior surface of the outer cyclone is substantially cylindrical, wherein the receiving chamber comprises a circular cross-sectioned tubular portion which is cylindrical around the axis with one end connected to the portion of the outer surface of the inner cyclone and the opposite end connected to the inner tapered surface of the receiving chamber in spaced relation to the cone opening wherein the tubular portion has a diameter smaller than the minimum diameter of the tapered wall such that finely divided dirt is trapped in the receiving chamber and wherein a diameter of the inner surface of the outer cyclone and the minimum diameter of the tapered surface of the receiving chamber is such that larger particles of the dirt are collected at the bottom of the outer cyclone and smaller particles of the dirt are collected inside the receiving chamber.

17. The apparatus of claim 16 wherein a flexible tapered seal is provided between the receiving chamber and the outer surface of the inner cyclone such that the inner cyclone is separable from the receiving chamber.

18. The apparatus of claim 17 wherein the tapered seal is composed of a series of concentric rings which engage the outer surface of the inner cyclone to provide the seal.

19. The apparatus of claim 16 wherein a flexible ring seal is provided between the outer cyclone and the chamber adjacent to the bottom of the outer cyclone to prevent air leakage during use.

20. The apparatus of claim 16 wherein the diameter of the inner surface of the outer cyclone and the minimum diameter of the tapered surface of the outer cyclone are approximately the same.

21. The apparatus of claim 20 wherein a flexible tapered seal is provided between the receiving chamber and the outer surface of the inner cyclone such that the inner cyclone is separable from the receiving chamber.

22. The apparatus of claim 21 wherein the tapered seal is composed of a series of concentric rings which engage the outer surface of the inner cyclone to provide the seal.

23. The apparatus of claim 16 wherein an airtight joint is provided between the outer cyclone and the receiving chamber adjacent to the bottom of the outer cyclone.

* * * * *

UNITED STATES PATENT AND TRADEMARK OFFICE

CERTIFICATE OF CORRECTION

PATENT NO. : 4,826,515

DATED : May 2, 1989

INVENTOR(S) : James Dyson

It is certified that error appears in the above—identified patent and that said Letters Patent is hereby corrected as shown below:

Column 2, line 33, "air" should be --the--.

Column 5, line 11, --25-- should be inserted after "slots".

Column 6, line 66 "heat 84" should be --head 84--.

Column 11, line 20 (Claim 10) "inlet" should be --outlet--.

Signed and Sealed this

Sixteenth Day of January, 1990

*Attest:*

JEFFREY M. SAMUELS

*Attesting Officer*

*Acting Commissioner of Patents and Trademarks*